US007753140B2

(12) United States Patent
Barbera

(10) Patent No.: US 7,753,140 B2
(45) Date of Patent: Jul. 13, 2010

(54) AUGER BORING MACHINE WITH INCLUDED PILOT TUBE STEERING MECHANISM AND METHOD OF USE

(76) Inventor: James S. Barbera, 1635 37th St. NW., Canton, OH (US) 44709

( * ) Notice: Subject to any disclaimer, the term of this patent is extended or adjusted under 35 U.S.C. 154(b) by 155 days.

(21) Appl. No.: 11/715,021

(22) Filed: Mar. 7, 2007

(65) Prior Publication Data

US 2008/0217069 A1 Sep. 11, 2008

(51) Int. Cl.
*E02D 29/00* (2006.01)

(52) U.S. Cl. ..... 175/62; 405/138

(58) Field of Classification Search ..... 175/62; 299/68, 60; 405/138; 173/217
See application file for complete search history.

(56) References Cited

U.S. PATENT DOCUMENTS 3,640,573 A * 2/1972 Safar ..... 299/31
3,902,563 A * 9/1975 Dunn ..... 175/62
4,732,226 A * 3/1988 Ebeling et al. ..... 175/94
5,125,460 A * 6/1992 Behrens ..... 173/184
5,186,579 A * 2/1993 Hanamoto et al. ..... 405/143
5,314,267 A * 5/1994 Osadchuk ..... 405/184
5,437,500 A * 8/1995 Lehmann et al. ..... 299/60
5,964,306 A * 10/1999 Barbera ..... 175/122
6,206,109 B1 3/2001 Monier et al.
7,389,831 B2 * 6/2008 Mullins et al. ..... 175/62

* cited by examiner

*Primary Examiner*—William P Neuder
*Assistant Examiner*—Cathleen R Hutchins
(74) *Attorney, Agent, or Firm*—Sand & Sebolt

(57) ABSTRACT

An auger boring machine includes a common power source for powering a drive motor which rotates an auger and a drive assembly which drives a pilot tube to form a pilot hole in the earth which is followed by the auger. The drive assembly is movable into and out of the operational position of the auger to allow the auger to be mounted on the drive motor. Preferably the drive assembly is removably mounted on the frame of the auger boring machine. An electric generator and hydraulic pump are powered by the common power source for operating various components of the drive assembly.

23 Claims, 10 Drawing Sheets

| FIG-5A | FIG-5B | FIG-5C |
|---|---|---|

AUGER BORING MACHINE WITH INCLUDED PILOT TUBE STEERING MECHANISM AND METHOD OF USE

BACKGROUND OF THE INVENTION

1. Technical Field

The invention relates generally to an auger boring machine and a method of use in the trenchless installation of underground pipe. More particularly, the invention relates to such a machine which utilizes a pilot tube for forming a pilot hole for guiding the auger of the machine. Specifically, the invention relates to a pilot tube drive assembly used for driving the pilot tube and a drive motor for rotating the auger wherein the drive assembly and dive motor are powered by a common power source.

2. Background Information

The use of an auger boring machine for installing underground pipe between two locations without digging a trench there between is broadly known. In addition, it is known to use a pilot tube formed of a plurality of pilot tube segments to create a pilot hole for guiding an auger which bores a larger hole so that the auger remains within a reasonably precise line and grade. For example, see U.S. Pat. No. 6,206,109 granted to Monier et al.

However, while the formation of the pilot hole necessarily precedes the boring of the larger hole with the auger, these two processes have heretofore have been performed by two independent machines. More particularly, the pilot tube and drive assembly utilizes a first power source for driving the pilot tube to form the pilot hole and the auger boring machine utilizes a second power source to rotate the auger and cutting head for boring the larger hole. The use of separate power sources results in a drive assembly having its own power source which is quite costly and also makes the assembly more cumbersome to handle.

BRIEF SUMMARY OF THE INVENTION

The present invention provides an auger boring machine comprising: a drive motor having a rotational output adapted for rotating an auger and soil-cutting head mounted thereon; a pilot tube drive assembly adapted for driving a pilot tube to form in the earth a pilot hole for guiding the cutting head and auger; and a common power source for powering the drive motor and drive assembly.

The present invention further provides a method comprising the steps of: powering a pilot tube drive assembly with a power source; driving a pilot tube with the drive assembly through the earth to form a pilot hole therein; powering a drive motor with the power source; and rotating an auger and cutting head with the drive motor to cut a hole in the earth which follows the pilot hole.

The present invention further provides an auger boring machine comprising: a drive motor having a rotational output adapted for rotating an auger and soil-cutting head mounted thereon; an auger operating space adjacent the rotational output for receiving the auger when mounted on the rotational output; and a pilot tube drive assembly adapted for driving a pilot tube to form in the earth a pilot hole for guiding the cutting head and auger; wherein the drive assembly is movable between a first position within the auger operating space for driving the pilot tube and a second position out of the auger operating space.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
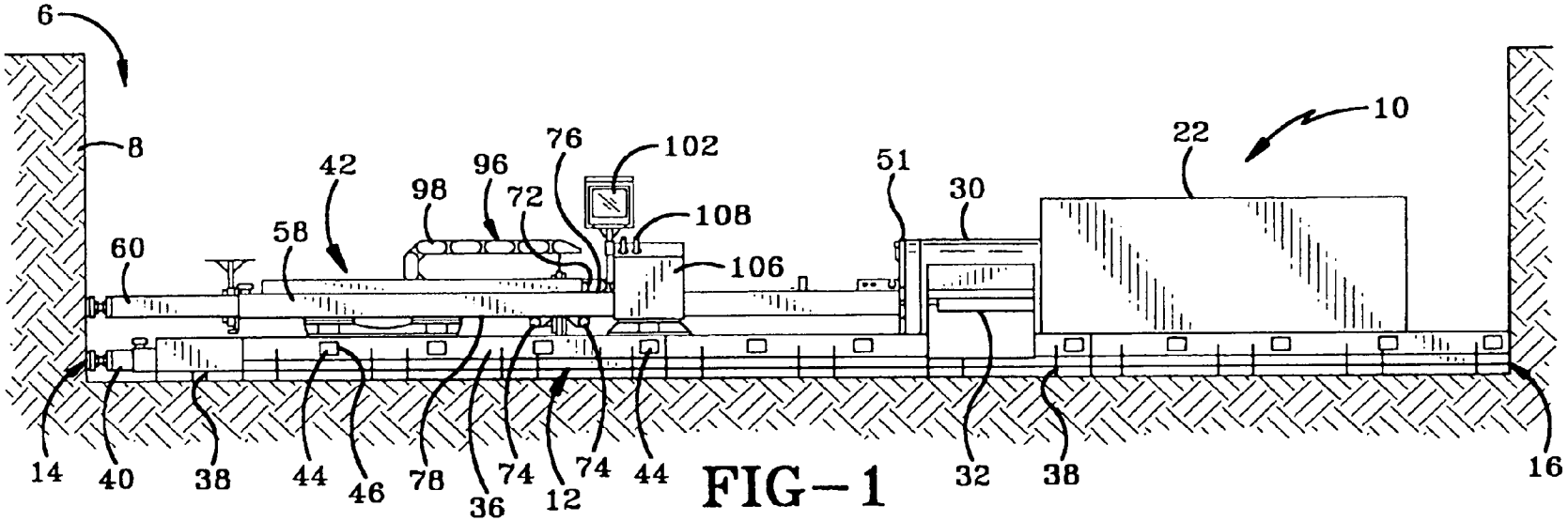
FIG. 1 is a side elevational view of the auger boring machine of the present invention shown in a pit formed in the earth.
Figure 2:
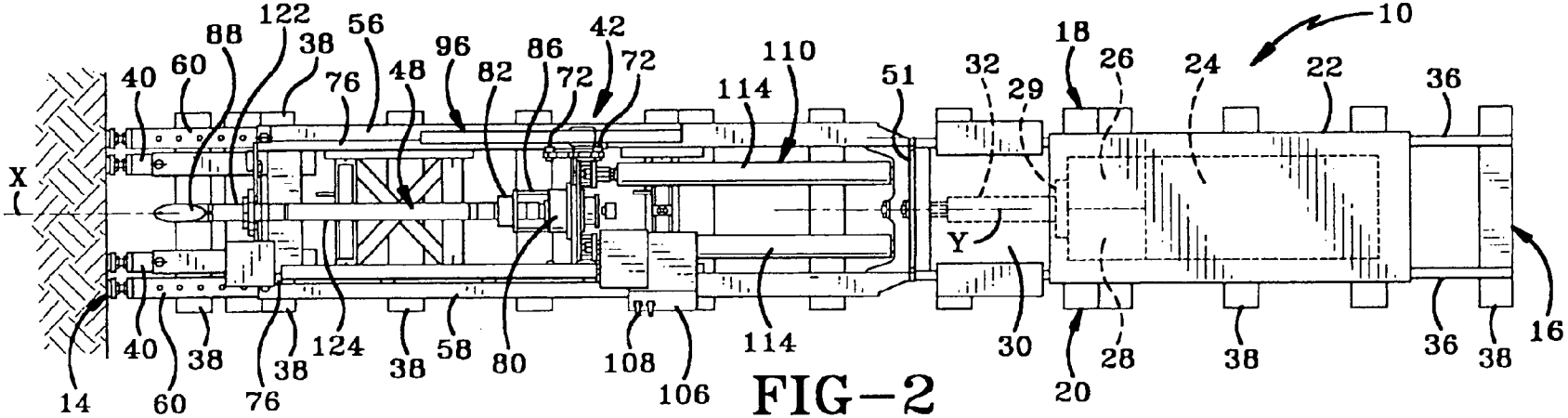
FIG. 2 is a top plan view of the auger boring machine.

The auger boring machine of the present invention is indicated generally at 10 in FIGS. 1 and 2. Referring to FIG. 1, machine 10 is typically disposed in a pit 6 formed in the earth's soil or ground 8 and configured to bore a hole through ground 8 for the purpose of laying underground pipe in the bored hole. Machine 10 typically bores a hole from within a pit such as pit 6 to another pit which may be spaced several hundred feet away. Machine 10 includes a frame 12 which extends from a front end 14 to a rear end 16 of machine 10. Front and rear end 14 and 16 define there between a longitudinal direction of machine 10. Machine 10 further has first and second opposed sides 18 and 20 (FIG. 2) defining there between an axial direction of machine 10.

Figure 10:
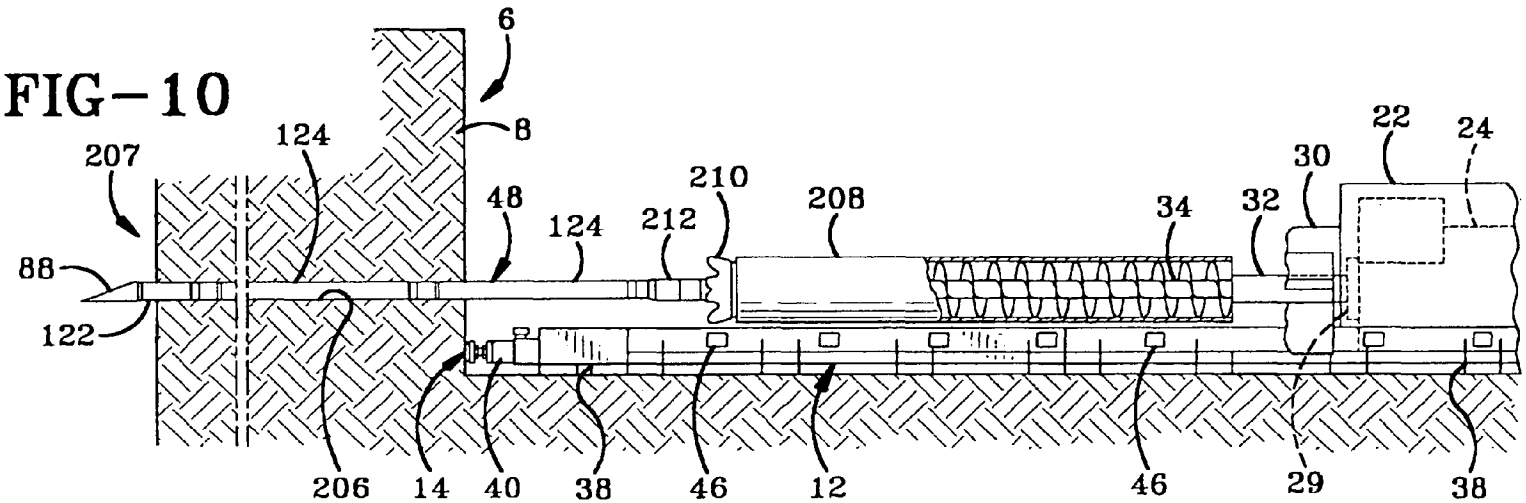
FIG. 10 is similar to FIG. 9 and shows the auger and swivel connected to the auger drive motor and pilot tube.

An engine compartment 22 is mounted on frame 12 and houses therein a fuel powered engine 24, an electric generator 26 powered by engine 24 and a hydraulic pump 28 also powered by engine 24. An auger drive housing or compartment 30 is disposed in front of compartment 22 and houses therein an auger drive motor 29 having a rotational output shaft 32 for rotationally driving an auger 34 (FIG. 10). It is emphasized in accordance with a feature of the invention that engine 24 serves as a single common power source for operating auger 34 as well as for powering drive mechanism 110

(FIG. 2) of pilot tube drive assembly 42 via generator 26 and hydraulic pump 28. Frame 12 further includes a pair of spaced longitudinally extending rails 36 secured to a plurality of cross bars 38 which are mounted on ground 8 in the bottom of pit 6. A pair of adjustable stabilizing poles 40 are telescopically received in and adjustably mounted respectively on rails 36 and configured to press against the wall of ground 8 which bounds pit 6.

Figure 3:
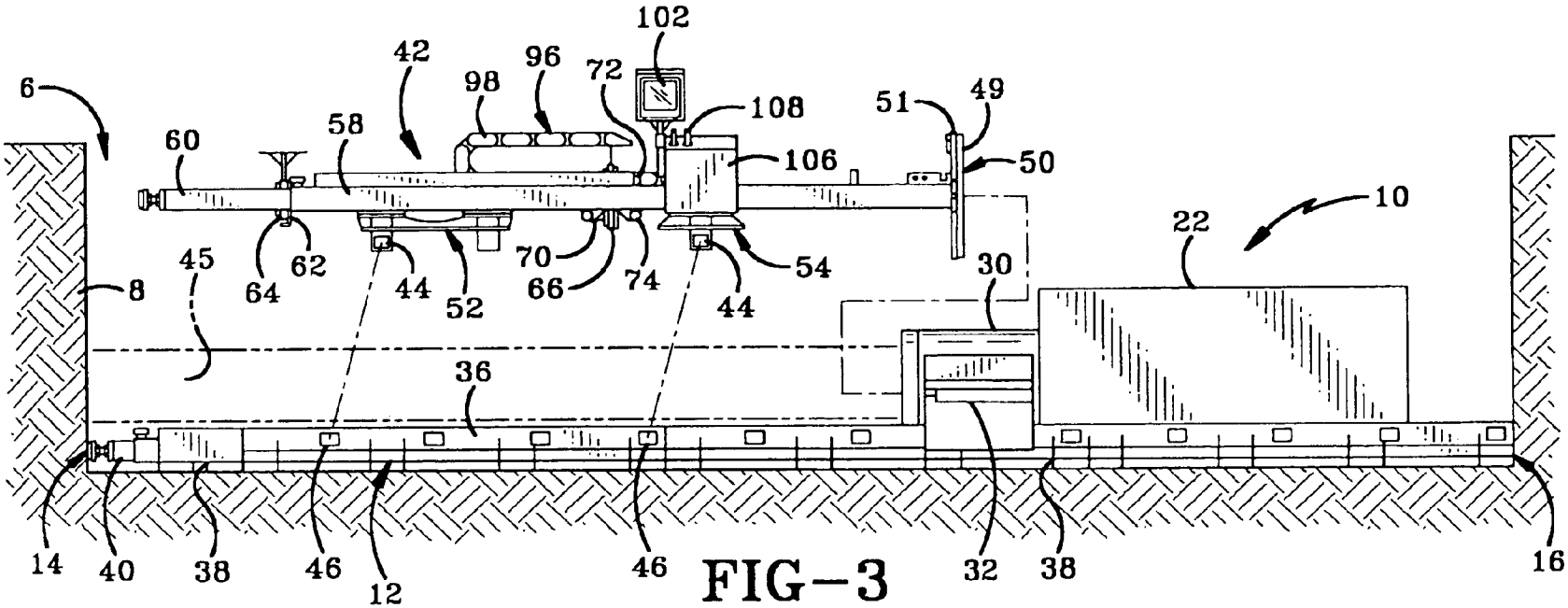
FIG. 3 is a side elevational view similar to FIG. 1 showing the pilot tube drive assembly removed from the frame of the boring machine.

In accordance with a feature of the invention, a pilot tube guidance and drive assembly 42 is removably mounted on frame 12 and more particularly on rails 36 via mounting legs 44 (FIG. 3) which are removably insertable into openings 46 formed in each of rails 36. Mounting legs 44 and the mounting mechanism of which they are a part are described in further detail in the copending application entitled Pilot Tube System And Attachment Mechanism for Auger Boring Machine which is incorporated herein by reference and filed concurrently herewith. Assembly 42 when mounted on frame 12 is positioned so that a central longitudinal axis X of a pilot tube 48 is coaxial with a longitudinal axis Y which passes centrally through output shaft 32 and about which shaft 32 is rotated when driving auger 34. Assembly 42 includes a generally circular rear plate 50 which abuts compartment 30 when assembly 42 is mounted on frame 12 and includes a rearwardly extending annular insert 49 which is inserted into compartment 30 and abuts an inner surface thereof to assist with the alignment of assembly 42. An annular flange 51 extends radially outwardly from insert 49 and abuts the front of compartment 30. Assembly 42 in its operational position is disposed in an auger operational space 45 (FIG. 3) which extends forward from shaft 32 and in which auger 34 (FIG. 10) subsequently operates. Assembly 42 is moved out of space 45 to allow auger 34 to be positioned therein.

Figures 4, 5:
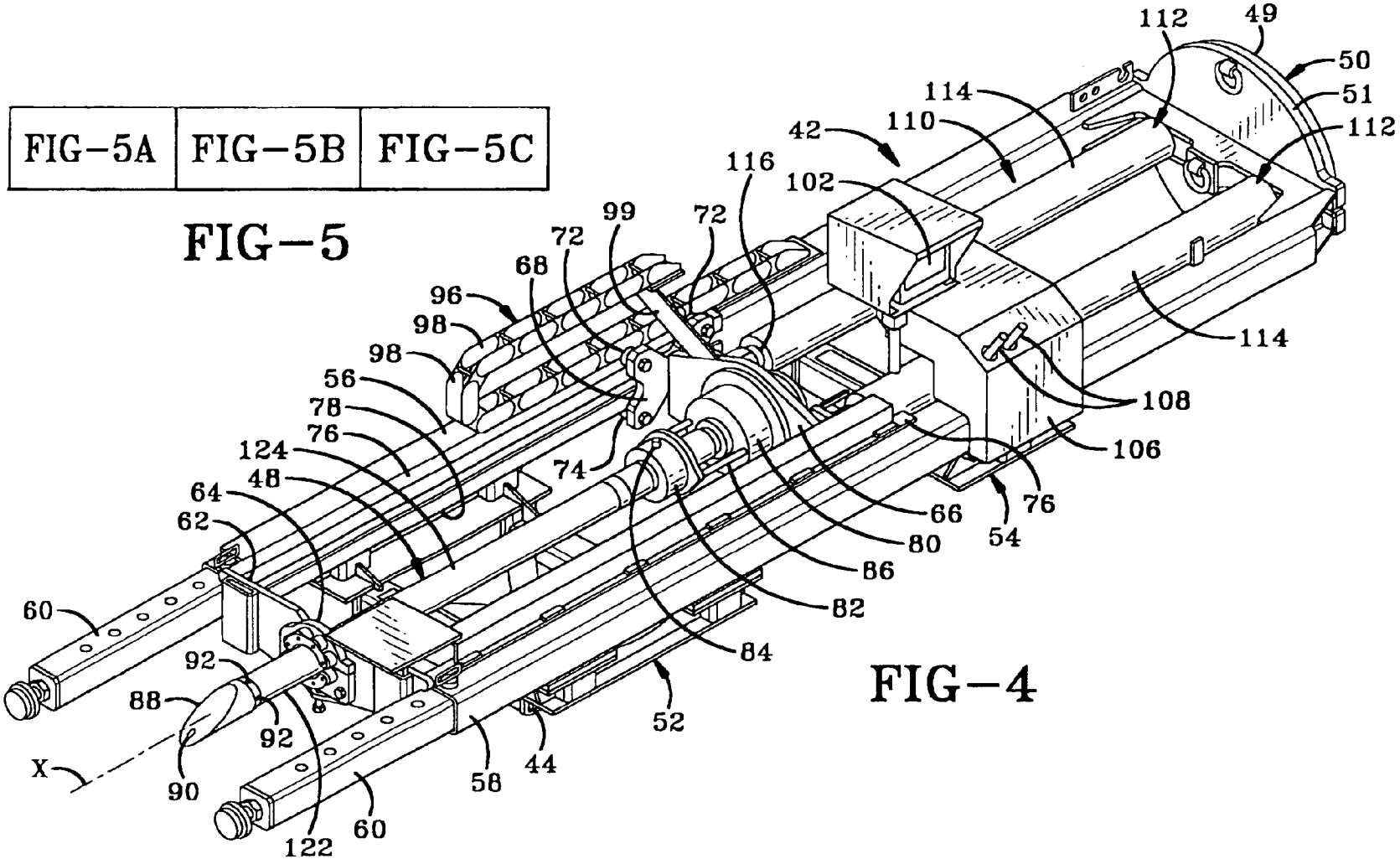
FIG. 4 is a perspective view of the drive assembly.
FIG. 5 is a diagrammatic view showing the relation of FIGS. 5A, 5B and 5C.
Figure 5A:
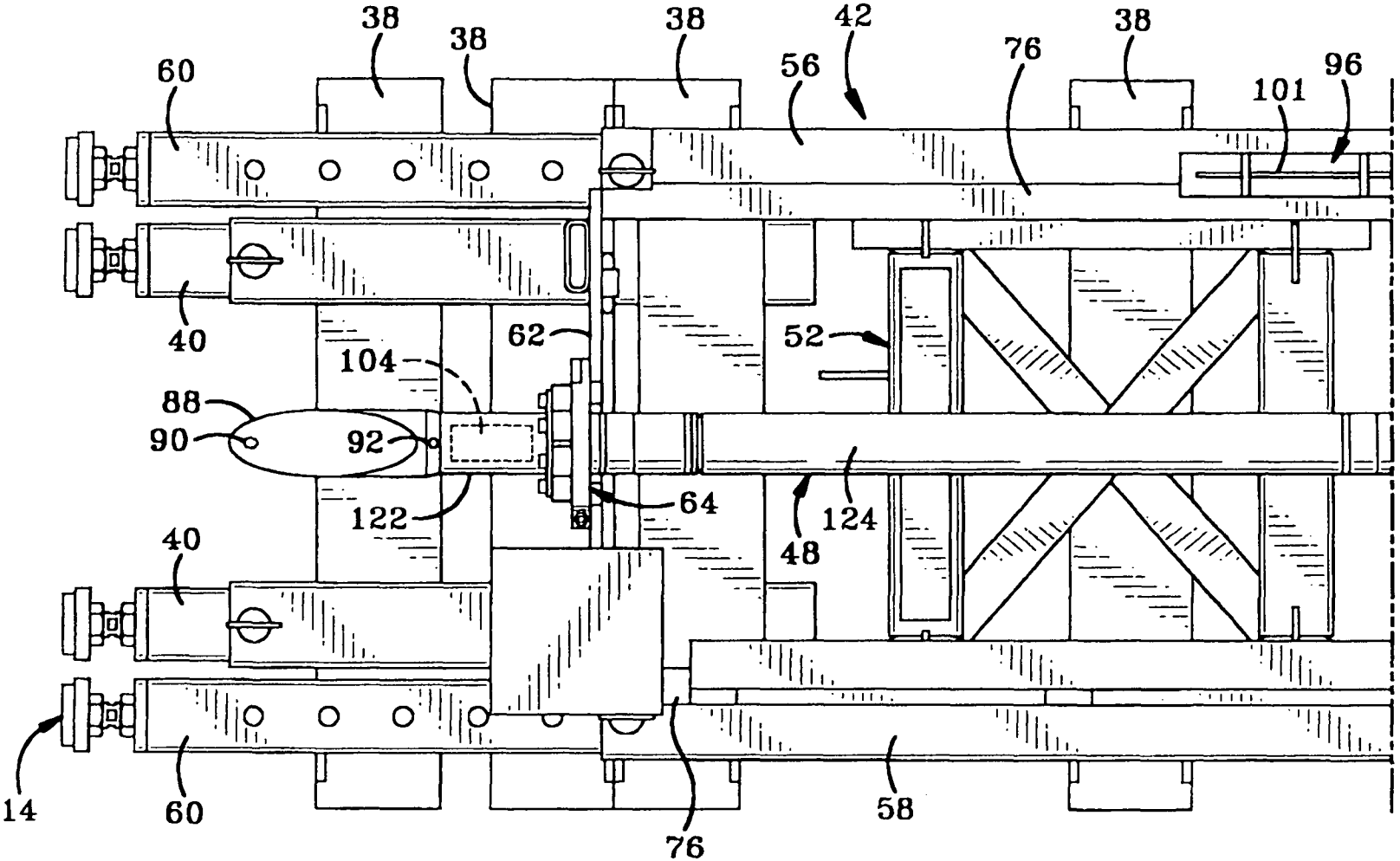
FIG. 5A is an enlarged top plan view of a front section of the pilot tube drive assembly.
Figure 5B:
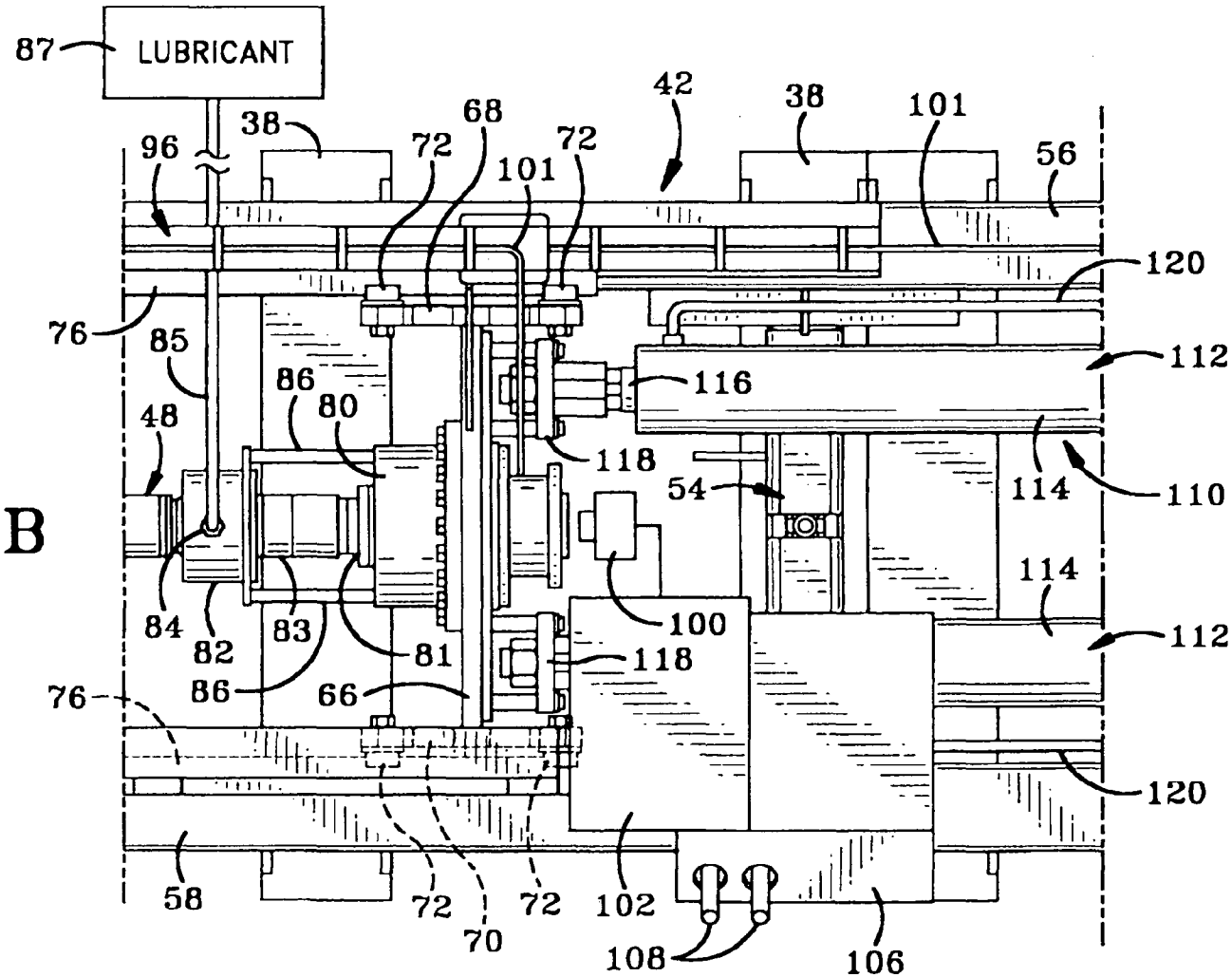
FIG. 5B is an enlarged top plan view of an intermediate section of the drive assembly.
Figure 5C:
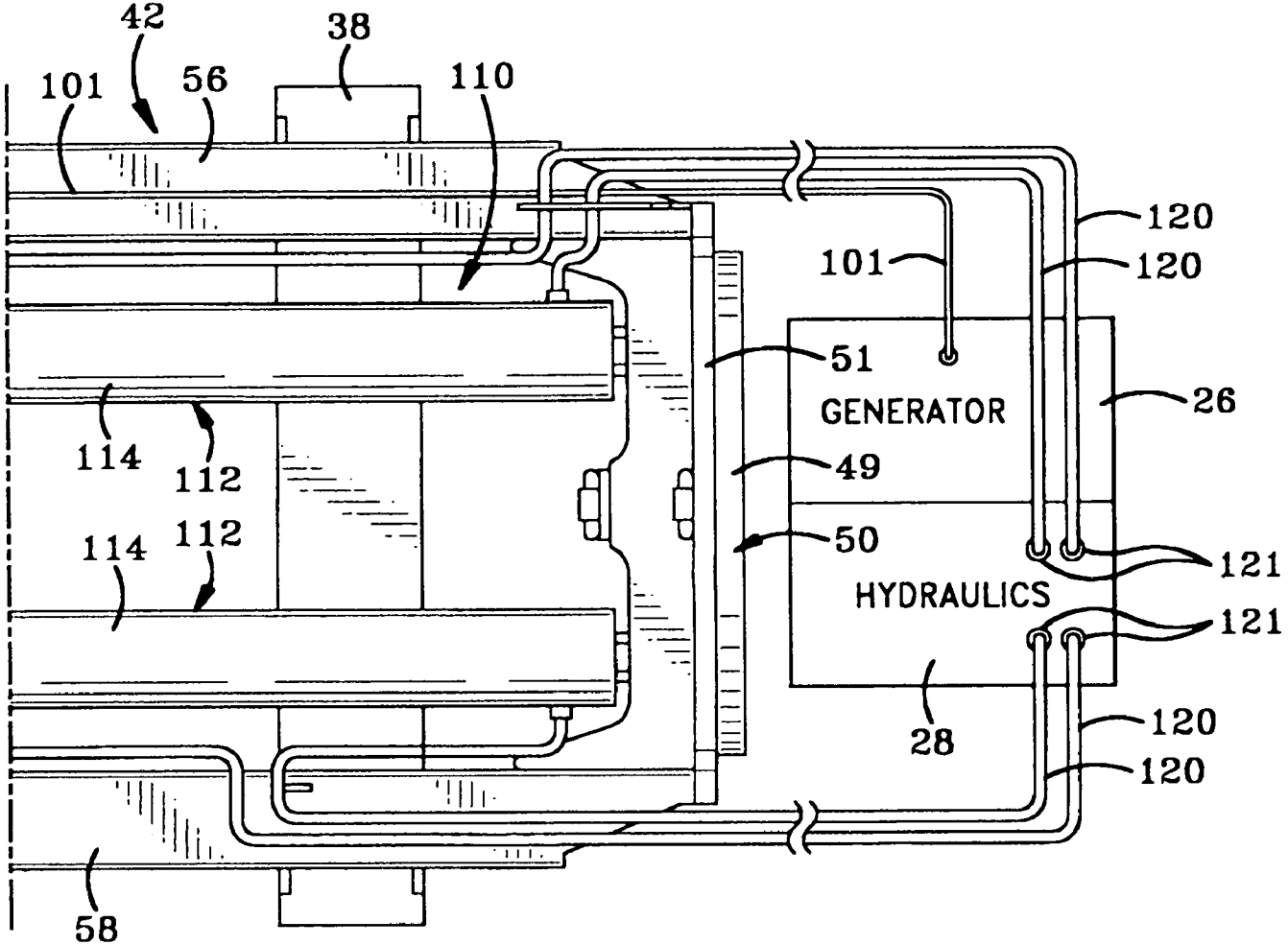
FIG. 5C is an enlarged top plan view of a rear section of the drive assembly.

Referring to FIGS. 4-5C, assembly 42 includes front and rear mounting assemblies 52 and 54 which also serve as supports providing rigid structure extending axially across the width of assembly 42. Assemblies 52 and 54 are seated on rails 36 of frame 12 when assembly 42 is mounted on frame 12. A pair of longitudinally extending parallel spaced rails 56 and 58 are rigidly mounted on assemblies 52 and 54 and extend along most of the length of assembly 42. Adjustable stabilizing poles 60 are telescopically mounted respectively within first and second rails 56 and 58 and are adjustable to provide force against ground 8 in the same manner as poles 40.

Figure 6:
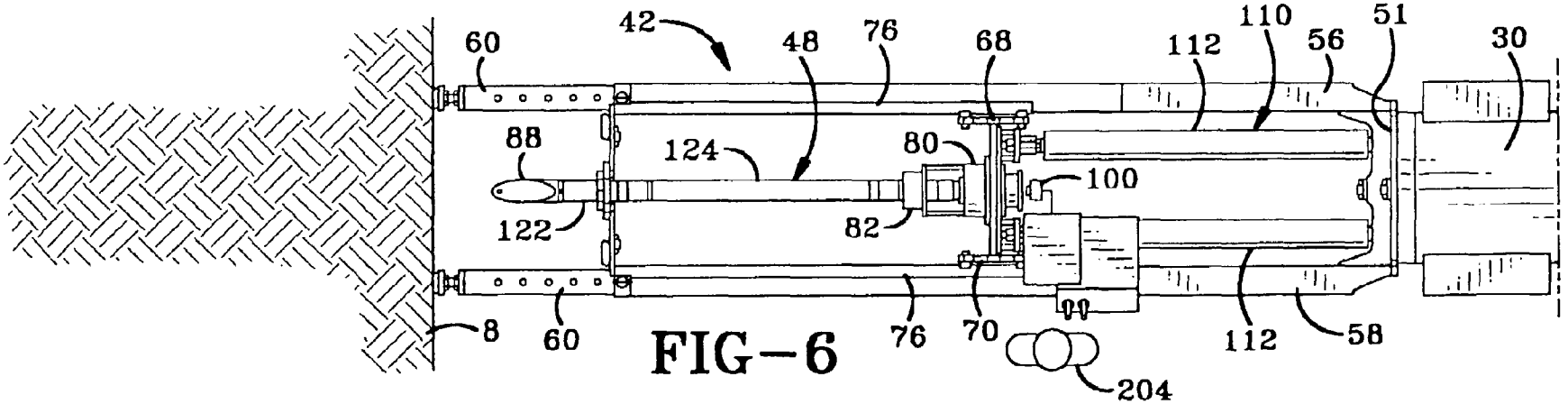
FIG. 6 is a top plan view of the pilot tube drive assembly prior to formation of the pilot hole.

A rigid front cross member 62 extends between and is connected to each of rails 56 and 58 adjacent the front thereof with a front pilot tube support 64 mounted thereon centrally between rails 56 and 58. Support 64 includes a plurality of bearings which engage the pilot tube 48 to allow longitudinal movement of tube 48 as well as rotational movement of tube 48 about axis X to allow for the steering thereof. Rear plate 50 and associated structure attached thereto serve as a rear cross member for rigidly connecting rails 56 and 58 to one another at the rear of assembly 42. An intermediate cross member 66 extends axially between rails 56 and 58 and is supported respectively on rails 56 and 58 by first and second roller assemblies 68 and 70 (FIGS. 5B and 6). Each roller assembly includes a pair of longitudinally spaced upper rollers 72 and longitudinally spaced lower rollers 74 (FIGS. 1, 4) which respectively rollingly engage upper and lower surfaces 76 and 78 (FIG. 1) of respective rails 56 and 58. Upper and lower surfaces 76 and 78 are parallel surfaces which extend longitudinally from the front of rails 56 and 58 to around the midway point between the front and rear of said rails.

An electric guidance control motor 80 is mounted on cross member 66 and includes a rotational output shaft 81 (FIG. 5B) which rotates about axis X for selectively rotating pilot tube 48 in either direction about axis X. A lubricant feed swivel 82 having a lubricant inlet 84 is mounted on motor 80 by a pair of spaced mounting rods 86 extending forward from motor 80. Swivel 82 is connected to pilot tube 48 and thus serves as an engaging member for drivingly engaging tube 48 during operation of assembly 42. Swivel 82 includes a central rotatable portion 83 mounted on shaft 81 and rotatable therewith about axis X to rotate pilot tube 48. As shown in FIG. 5B, inlet 84 of swivel 82 is in fluid communication with a lubricant feedline 85 which is in fluid communication with a source 87 of lubricant, which is typically water. Source 87 includes a pump for pumping water. Swivel 82 receives water through inlet 84 to pump the water through pilot tube 48 and through a steering head 88 connected to the front of pilot tube 48, the water flowing out a forward exit opening 90 and a plurality of lateral exit openings 92. The lubrication system of assembly 42 is described in further detail in the copending application entitled Lubricated Pilot Tubes For Use With Auger Boring Machine Pilot Steering System which is incorporated herein by referenced and filed concurrently herewith. A cord carrier 96 is mounted atop rail 56 and includes a plurality of links 98 which are pivotally connected to one another so that electrical cords 101 (FIGS. 5A-5C) will not become tangled during the longitudinal driving of pilot tube 48. A support arm 99 extends from cross member 66 to one of links 98 to provide support to the upper section of carrier 96. Electrical cord 101 is electrical communication with motor 80 as shown in FIG. 5B and with generator 26 as shown in FIG. 5C. Motor 80 is one of several electrically powered components on assembly 42 which are powered by generator 26.

During the jacking and driving of pilot tube 48, a steering mechanism keeps tube 48 on line and grade using a theodolite which utilizes a camera 100 (FIG. 5B) in electrical communication with a display monitor 102 which displays the view of the camera through pilot tube 48 of an illuminated LED target 104 (FIG. 5A) disposed within pilot tube 48 adjacent steering head 88. In order for camera 100 to view LED target 104, pilot tube 48 is hollow, as are the other structures intermediate camera 100 and target 104, such as motor 80 and swivel 82, in order to provide a line of sight Z (FIG. 7) between camera 100 and target 104. A guidance control unit 106 is mounted on rail 58 and includes manually operable controls 108 typically in the form of joysticks in electrical communication with motor 80 in order to send a signal to motor 80 to control rotation of pilot tube 48. Camera 100, monitor 102 and control unit 106 are in electrical communication with generator 26 and thus powered thereby.

With reference to FIGS. 4, 5B and 5C, assembly 42 includes a continuous stroke drive mechanism 110 comprising a pair of hydraulic actuators in the form of piston-cylinder combinations 112. Each combination 112 includes a cylinder 114 and a piston 116 slidably received therein. Each cylinder 114 is mounted on the rear cross member adjacent plate 50 while each piston 116 is mounted on intermediate cross member 66 via a respective pair of mounting brackets 118 (FIG. 5B). A pair of hydraulic lines 120 (FIGS. 5B-5C) extends from hydraulic pump 28 to each of hydraulic cylinders 114 with one of lines 120 connected to cylinder 114 adjacent the rear end thereof and the other connected adjacent the front end thereof in order to respectively provide extension and retraction of the respective piston 116. Releasable connections 121 (FIG. 5C) are provided for connection and disconnection of lines 120 from pump 28 to facilitate installation and removal of drive assembly 42. Pistons 116 extend and retract simultaneously along paths that are parallel to one another and substantially parallel to axis X of pilot tube 48. Combinations 112 must provide a substantial amount of forward and reverse thrust. For example, the forward thrust produced by combinations 112 on one preferred embodiment has a maximum thrust of 280,000 pounds while the reverse thrust has a maximum thrust of 140,000 pounds. Combinations 112 are capable of a continuous stroke throughout the extension thereof and likewise during the retraction thereof for driving and retracting cross member 66 and the associated structure mounted thereon which engages pilot tube 48. During the extension and retraction of pistons 116, rollers 72 and 74 of assemblies 68 and 70 maintain contact with upper and lower surfaces 76 and 78 of rails 56 and 58 in order to eliminate vertical play of intermediate cross member 66 and the associated structure connected thereto. The pilot tube drive mechanism of the present invention, including a rack and pinion drive mechanism, are described along with various other aspects of the invention in further detail in the copending application entitled Method And Apparatus For Providing A Continuous Stroke Auger Boring Machine which is incorporated herein by referenced and filed concurrently herewith.

Pilot tube 48 is made up of a plurality of pilot tube segments which are connected end to end to sequentially increase the length of pilot tube 48 during the jacking process. Typically, all or nearly all of the pilot tube segments are of the same length and are interchangeable with one another. However, some of the pilot tube segments may be of a different length, such as the lead pilot tube segment 122, which is connected to steering head 88 and which is shorter than the standard pilot tube segments 124 connected sequentially behind segment 122. Lead pilot tube segment 122 houses LED target 104.

Figure 7:
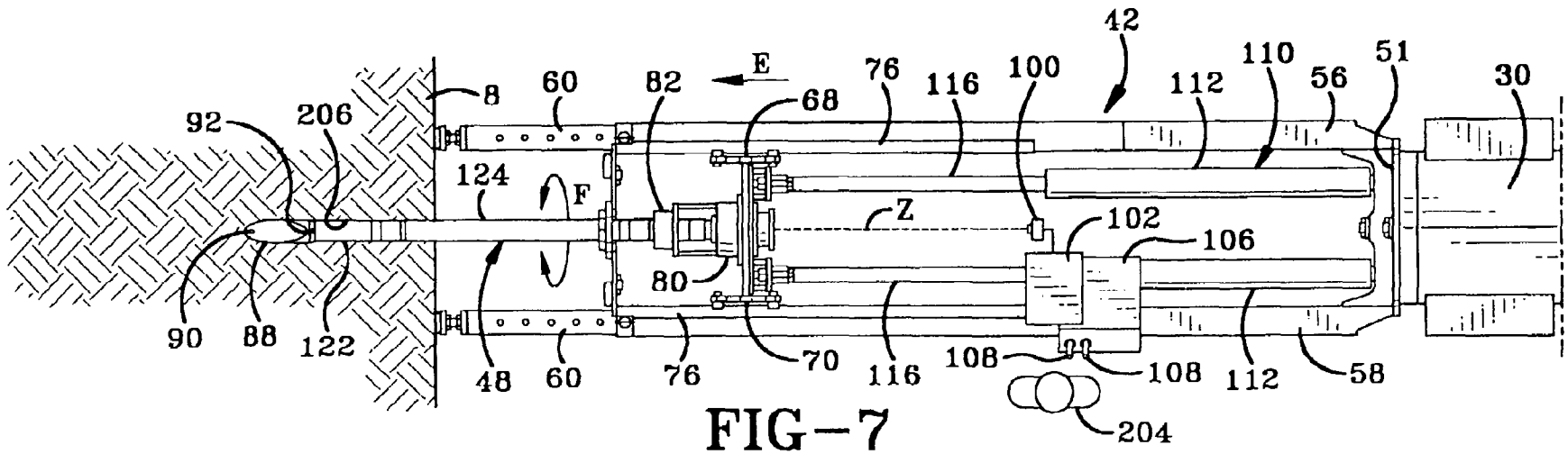
FIG. 7 is a top plan view of the drive assembly showing an extension of the hydraulic actuators to provide an initial stage of pilot hole formation and also showing the steering capability of the pilot tube.

The operation of boring machine 10 is now described with reference to FIGS. 6-11. FIGS. 6-7 are shown without main frame 12 of machine 10 for simplicity. FIG. 6 shows assembly 42 prior to the jacking or driving of pilot tube 48 to form a pilot hole with an operator 204 preparing to begin operation of assembly 42. The pistons of piston cylinder combinations 112 are shown in a fully retracted position FIG. 6. Assembly 42 is operated to actuate combinations 112 in order to extend pistons 116 thereof to drive pilot tube 48 into ground 8 as indicated in arrow E in FIG. 7 to form the initial stages of a pilot hole 206. During the extension of pistons 116 and pilot tube 48, camera 100 senses or receives input from LED target 104 and relays the images of illuminations (not shown) from target 104 on monitor 102. Operator 204 views display monitor 102 in order to determine whether steering head 88 needs to be adjusted to maintain the line and grade of pilot tube 48. Operator 204 will use controls 108 in order to make any necessary adjustments, specifically rotating pilot tube 48 as indicated in arrow F in *Fig.* 7 via motor 80. For use with longer pilot holes, machine 10 may include additional steering control mechanisms, as described in further detail in the copending application entitled Auger Boring Machine With Two-Stage Guidance Control System which is incorporated herein by referenced and filed concurrently herewith. Simultaneously with driving and steering pilot tube 48, water may be pumped through pilot tube 48 via swivel 82 to steering head 88 and through the exit openings thereof in order to facilitate the formation of pilot hole 206.

Tube segments 124 are added (process not shown) to lengthen pilot tube 48 and the driving of pilot tube 48 goes on until the pilot hole is completed or more particularly so that the pilot tube 48 extends out of ground 8 into a space which may be another pit 207 where sections of pilot tube 48 may be removed as the auger boring operation is underway, which moves pilot tube 48 gradually forward.

Figure 8:
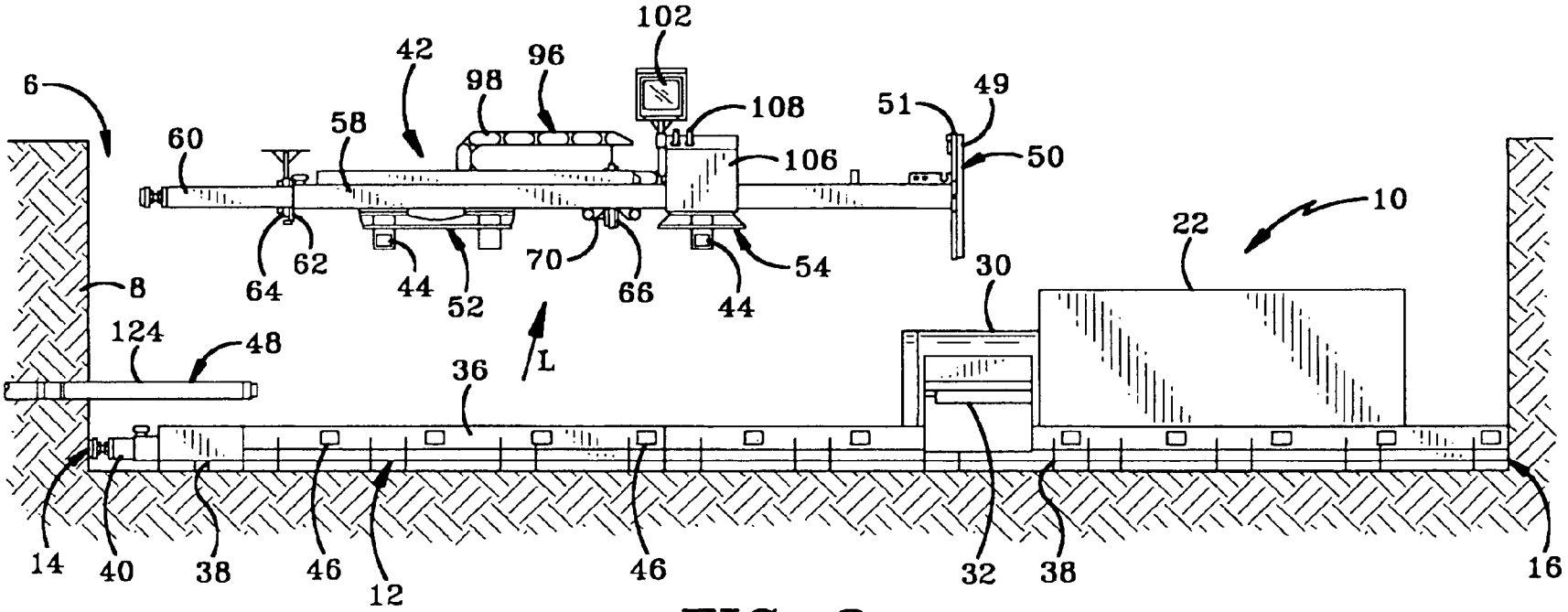
FIG. 8 is a side elevational view of the boring machine showing the drive assembly being removed from the frame of the auger boring machine.
Figure 9:
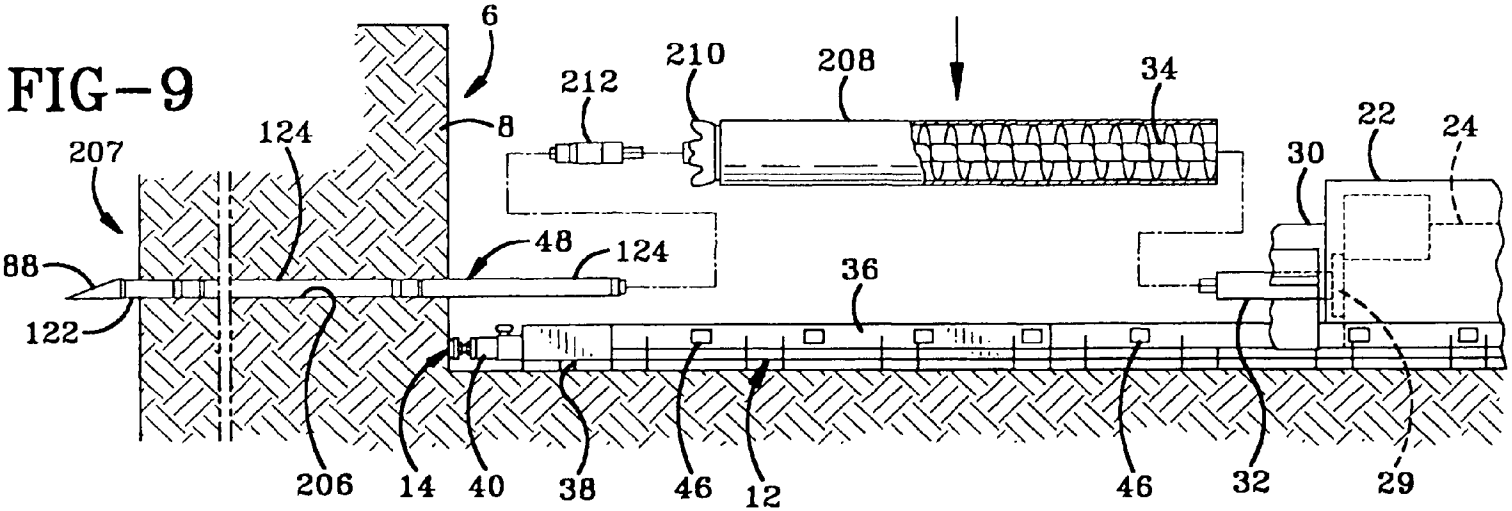
FIG. 9 is similar to FIG. 8 and shows an auger and swivel positioned prior to respective connection to the auger drive motor and the pilot tube.
Figure 11:
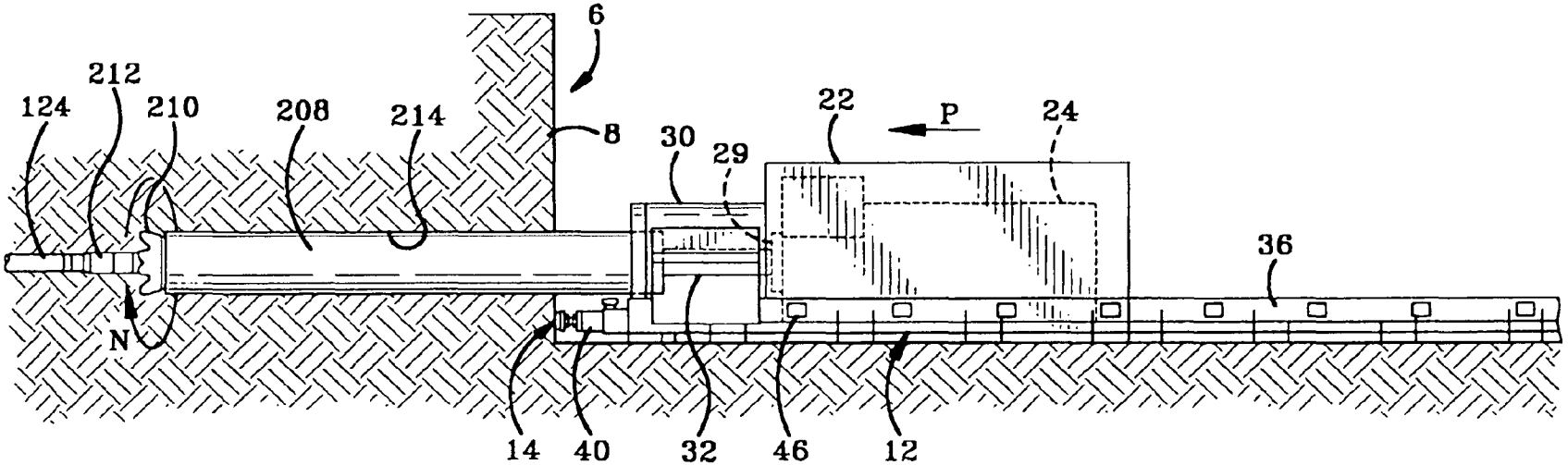
FIG. 11 is similar to FIG. 10 and shows the auger boring an enlarged diameter hole as it follows the pilot tube.

Once pilot hole 206 is completed, assembly 42 is removed from frame 12 of auger boring machine 10 as indicated at arrow L in FIG. 8. As shown in FIG. 9, auger 34 is then prepared for connection to output shaft 32 along with the pipe or casing 208 in which auger 34 is disposed and cutting head 210 connected to the front of auger 34 (FIG. 9). A swivel 212 is also connected to the trailing end of pilot tube 48 and the front of cutting head 210 to allow for the rotation of auger 34 and cutting head 210 without rotating pilot tube 48. Swivel 212 is described in greater detail in the copending application Method of Installing Large Diameter Casing and Swivel For Use Therewith which is incorporated herein by referenced and filed concurrently herewith. Cutting head 210 and casing 208 has a diameter which is substantially larger than that of pilot tube 48. As shown in FIG. 11, engine 24 is then operated to rotate output shaft 32, auger 34 and cutting head 210 (arrow N) as engine 24 moves forward on rails 36 with auger 34 as indicated at arrow P to form a larger diameter hole 214 in which casing 208 will be disposed to form underground piping. Auger 34 carries soil cut by cutting head 210 rearwardly to discharge from its trailing end so that it can be removed from pit 6. Additional casings 208 with augers 34 disposed therein are connected in end to end fashion to increase the length of the pipe to be laid, each casing 208 being welded to the subsequent casing 208.

Thus, auger boring machine 10 provides a fuel powered engine 24 which serves as a common power source for powering drive assembly 42 which drives pilot tube 48 and for powering drive motor 29 for rotating shaft 32 and auger 34. The ability to move assembly 42 out of the operational space of auger 34, including the removal of assembly 42 from frame 12, provides the use of such a common power source in a relatively compact manner.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An auger boring machine comprising:

an auger boring machine frame having front and rear opposed ends defining therebetween a longitudinal direction;

a drive motor having a rotational output adapted for rotating an auger and soil-cutting head mounted thereon; wherein the drive motor is mounted on and movable relative to the auger boring machine frame in the longitudinal direction with the rotational output mounted to rotate about a longitudinally extending axis;

an auger operating space adjacent the rotational output for receiving the auger when mounted on the rotational output; and a pilot tube drive assembly adapted for driving a pilot tube to form in earth a pilot hole for guiding the cutting head and auger;

wherein the drive assembly is movable between a first position within the auger operating space for driving the pilot tube and a second position out of the auger operating space; and wherein in the first position, the pilot tube drive assembly and the drive motor are mounted on the auger boring machine frame.

2. The machine of claim 1 further comprising a common power source for powering the drive motor and drive assembly.

3. The machine of claim 1 wherein in the first position, the pilot tube drive assembly is adjacent the rotational output of the drive motor.

4. The machine of claim 3 further comprising an auger drive housing which houses the rotational output; and wherein in the first position, the pilot tube drive assembly abuts the housing.

5. An auger boring machine comprising:

an auger boring machine frame having front and rear opposed ends defining therebetween a longitudinal direction;

a drive motor having a rotational output adapted for rotating an auger and soil-cutting head mounted thereon; wherein the drive motor is mounted on and movable relative to the auger boring machine frame in the longitudinal direction with the rotational output mounted to rotate about a longitudinally extending axis;

an auger operating space adjacent the rotational output for receiving the auger when mounted on the rotational output; and a pilot tube drive assembly adapted for driving a pilot tube to form in earth a pilot hole for guiding the cutting head and auger;

wherein the drive assembly is movable between a first position within the auger operating space for driving the pilot tube and a second position out of the auger operating space; and wherein in the first position, the pilot tube drive assembly and the drive motor are mounted on the auger boring machine frame;

further comprising an auger drive housing which houses the rotational output; and wherein the pilot tube drive assembly comprises an insert; and in the first position, the pilot tube drive assembly is adjacent the rotational output of the drive motor, the pilot tube drive assembly abuts the housing, and the insert is inserted into the housing.

6. The machine of claim 5 wherein the pilot tube drive assembly is adapted for driving the pilot tube to form in earth the pilot hole for guiding the cutting head and auger in cutting a hole having a diameter larger than that of the pilot hole; and further comprising a common power source for powering the drive motor and drive assembly.

7. The machine of claim 6 further comprising a steering motor powered by the power source and having a rotational output adapted for rotating the pilot tube.

8. The machine of claim 7 further comprising an electric generator powered by the power source and in electrical communication with the steering motor.

9. The machine of claim 6 further comprising at least one electrically powered component on the drive assembly; and an electric generator powered by the power source and in electrical communication with the at least one electrically powered component.

10. The machine of claim 9 wherein the at least one electrically powered component comprises a pilot tube guidance control unit.

11. The machine of claim 9 wherein the at least one electrically powered component comprises a camera.

12. The machine of claim 9 wherein the at least one electrically powered component comprises a display monitor.

13. The machine of claim 6 further comprising a pilot tube engaging member linearly movable substantially along the axis and adapted to drivingly engage the pilot tube.

14. The machine of claim 13 wherein the engaging member is rotatable about the axis.

15. The machine of claim 6 wherein the power source comprises a fuel-powered engine.

16. The machine of claim 6 further comprising a hydraulic pump powered by the power source; at least one hydraulically powered component on the drive assembly; and a plurality of hydraulic lines in communication with the hydraulic pump and component.

17. The machine of claim 16 wherein the component comprises a hydraulic drive mechanism.

18. The machine of claim 6 wherein the drive motor is housed in the housing.

19. The machine of claim 6 further comprising the pilot tube, the pilot tube having leading and trailing ends; and a steering head secured to the leading end of the pilot tube; and wherein the pilot tube and steering head are together rotatable alternately in opposite directions during driving of the pilot tube to keep the pilot tube on line and grade.

20. The machine of claim 6 further comprising the pilot tube, the auger, the soil-cutting head and a pipe having a diameter larger than that of the pilot tube whereby the pipe is adapted to fit within the larger diameter hole and not fit within the pilot hole; and wherein the auger has leading and trailing ends; the auger is rotatably disposed within the pipe whereby the auger is adapted when rotated to move soil within the pipe from the leading end to the trailing end of the auger; the soil-cutting head is secured to the leading end of the auger; and the auger and soil-cutting head rotate independently of the pilot tube.

21. The machine of claim 6 further comprising the pilot tube, the auger, the soil-cutting head and a swivel; and wherein each of the pilot tube, the swivel and the auger has leading and trailing ends; and the auger boring machine has first and second alternate configurations such that in the first configuration the trailing end of the pilot tube is connected to the pilot tube drive assembly; and in the second configuration the trailing end of the pilot tube is disconnected from the pilot tube drive assembly and connected to the leading end of the swivel, the trailing end of the swivel is connected to the cutting head, and the cutting head is connected to the leading end of the auger to allow for rotation of the auger and soil-cutting head without rotating the pilot tube.

22. The machine of claim 6 wherein the pilot tube has leading and trailing ends and is hollow from adjacent the leading end to the trailing end; and further comprising a steering head secured to the leading end of the pilot tube; an illuminated target within the pilot tube adjacent the leading end; a camera adjacent the trailing end of the pilot tube positioned to view the target through the hollow tube.

23. The machine of claim 22 further comprising a display monitor on the drive assembly in communication with the camera for receiving images therefrom.

* * * * *